United States Patent [19]

Watson

[11] 4,213,307

[45] Jul. 22, 1980

[54] OIL SEPARATION AND RETURN SYSTEM FOR CENTRIFUGAL REFRIGERANT COMPRESSORS

[75] Inventor: Thomas E. Watson, Staunton, Va.

[73] Assignee: Westinghouse Electric Corp., Pittsburgh, Pa.

[21] Appl. No.: 960,362

[22] Filed: Nov. 13, 1978

[51] Int. Cl.[2] ..... F25B 31/00

[52] U.S. Cl. ..... 62/192; 62/225; 62/468; 62/500

[58] Field of Search ..... 62/84, 224, 225, 192, 62/191, 468, 500, 116

[56] References Cited

U.S. PATENT DOCUMENTS

| | | | |
|---|---|---|---|
| 3,555,845 | 1/1971 | Huelle | 62/225 |
| 3,575,264 | 4/1971 | Johnson et al. | 417/13 |
| 3,601,501 | 4/1971 | Johnson | 416/244 |
| 3,619,086 | 11/1971 | Johnson et al. | 417/360 |
| 3,635,579 | 1/1972 | Wood | 415/119 |
| 3,635,580 | 1/1972 | Richardson et al. | 415/150 |
| 3,927,889 | 12/1975 | Adams, Jr. et al. | 277/25 |
| 3,927,890 | 12/1975 | Adams, Jr. | 277/29 |

*Primary Examiner*—Ronald C. Capossela
*Attorney, Agent, or Firm*—E. C. Arenz

[57] ABSTRACT

A refrigerant system with a high speed centrifugal compressor has an arrangement for promoting the continuous return of oil to gear and bearing housing 12 including a coalescing type filter 62 from which separated oil is passed to a jet pump 74, a thermostatically controlled expansion valve 50 operating at a low superheat value, and inwardly pumping shaft seals 26.

6 Claims, 5 Drawing Figures

FIG. 4
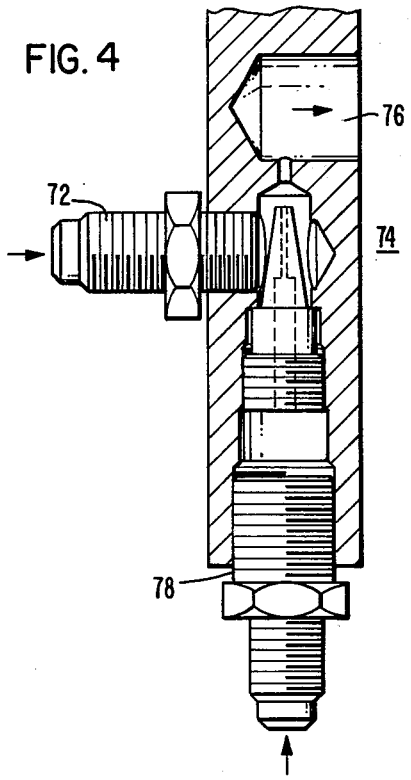
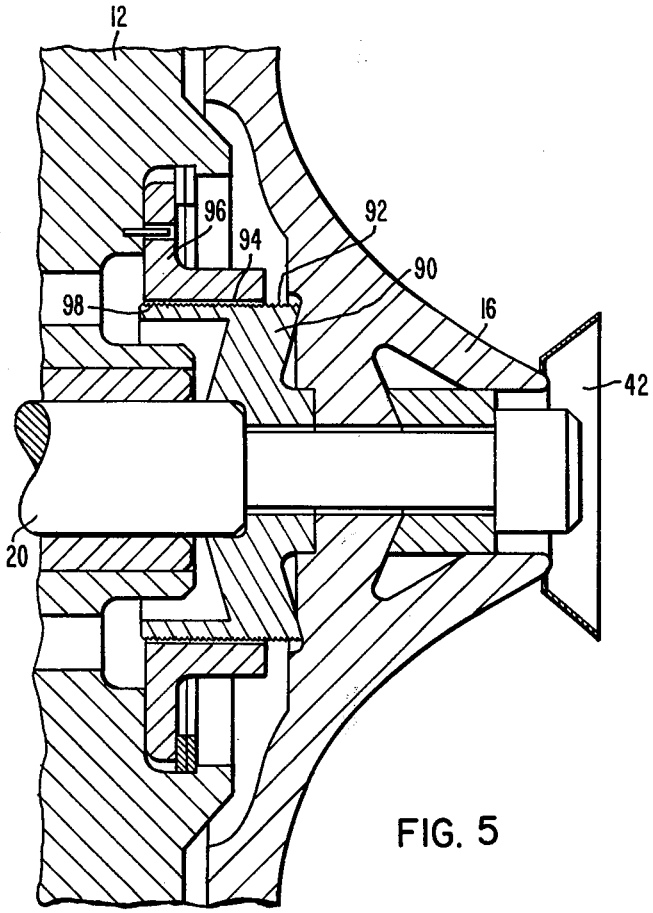
FIG. 5

OIL SEPARATION AND RETURN SYSTEM FOR CENTRIFUGAL REFRIGERANT COMPRESSORS

BACKGROUND OF THE INVENTION

1. Field of the Invention

The invention pertains to the art of oil return systems for centrifugal refrigerant gas compressors.

2. Description of the Prior Art and Additional Background

U.S. Pat. Nos. 3,927,889 and 3,927,890 disclose improved seal arrangements for inhibiting the leakage of refrigerant gas from the compressor discharge space to the compartment containing the gears and bearings for driving the compressor impeller located in the compressed gas collecting scroll.

Centrifugal refrigerant compressors of the type disclosed in those patents, and typically used in liquid chiller packages for example, are arranged in an overall hermetic system in which the gear and bearing compartment or housing is vented to the suction space upstream of the impeller. Those patents should be referred to for somewhat detailed reasons for attempting to provide a highly effective seal between the high pressure discharge space and gear and bearing housing. However, for purposes of this patent application it may be stated that centrifugal compressors of this type should provide venting to the suction side of the impeller or else the pressure in the gear and bearing housing will build to a level that oil may be driven or blown into the motor box containing the electric motor which drives the shafts and gears.

As pointed out in the patents, the centrifugal compressor assemblies of the type of concern in this patent application is of a design in which compactness is considered an important feature. This is achieved in part by the use of a relatively small, high speed compressor arrangement in which the compressor impeller is driven at nominal speeds of 34,000 RPM. In obtaining overall compactness of the compressor assembly, the gear and bearing housing is also relatively compact so that the oil capacity contained in the housing is limited. For example with a centrifugal compressor of the compact size having approximately 100 tons refrigeration producing capacity, the oil capacity is approximately 2.8 gallons initially residing in the sump of the housing. The small housing also means the internal volume and internal surface area in the housing are relatively limited. Thus the total amount of oil mist which circulates in the housing and then drops back into the sump is somewhat limited. That oil which is not on a surface or in the sump is subject to being entrained by the refrigerant gas being vented back to the refrigerant system at a rate of carryout generally proportional to the refrigerant venting rate. The oil carried out is separated from the gas and stored in an accumulator. In time the oil in the accumulator reaches a volume that a shutdown of the system is required to permit drainage of the oil from the accumulator back to the gear and bearing housing. In the noted patents it is pointed out that the seal arrangements of those inventions are intended to substantially reduce leakage to minimize the oil carryout to lengthen the time between required shutdowns.

The approach of my invention is based upon the concept that while the centrifugal refrigeration compressor and system are intended to be designed so that oil does not circulate with the refrigerant, oil in any event will be lost to the refrigerant through leaking O-ring seals, gaskets, refrigerant cooled oil coolers, casting porosity, and so on, and that as a practical matter it is very difficult to have a perfectly leak-free unit without undue cost. Hence, recognizing this to be the case, my invention contemplates a system in which provision is made throughout the system for accomplishing the continuous return of the oil to the gear and bearing housing, with a key part of the system being a relatively small, highly efficient oil and gas separator or filter of a type not heretofore used in this art and incorporated in a system to provide continuous return of oil

SUMMARY OF THE INVENTION

In accordance with the invention, in a high speed centrifugal refrigerant compressor of the type which includes a motor housing space, a separate gear and bearing housing space containing an oil sump, and a separate compressor casing space containing a high speed impeller driven by a shaft extending into the casing space from the gear and bearing housing, a system is provided for venting refrigerant gas from the gear and bearing housing to the suction space of the compressor and continuously returning oil entrained in the venting refrigerant gas to the gear and bearing housing. This is accomplished through an arrangement including a relatively small filter housing having an oil and gas inlet, a gas outlet, and an oil outlet, the housing having a high efficiency coalescing filter medium in it with the upstream side of the medium being in communication with the inlet, and both the gas and oil outlets being in communication with the downstream side of the medium. An oil and refrigerant gas line connects the interior of the gear and bearing housing to the oil and gas inlet of the filter housing, a refrigerant gas line connects the gas outlet of the housing to the suction space to provide a source of suction for venting refrigerant and entrained oil from the gear and bearing housing, and oil pump means is provided having an inlet connected to receive oil from the filter housing oil outlet and having an outlet connected to the interior of the gear and bearing housing to continuously return to the gear and bearing housing oil extracted from the coalescing filter medium while the compressor is operating. In the preferred form the first oil pump means comprises a jet pump, and the gear and bearing housing includes second oil pump means for supplying oil to the bearings in the gear and bearing housing and also supplying pressurized oil to the jet pump to serve as the motive fluid for the jet pump.

Further in accordance with the invention, the overall refrigeration system includes expansion valve means responsive to suction line temperatures to control admission of refrigerant to the evaporator in the system to normally maintain a relatively low superheat in the range of about 0° to 6° F. to promote the removal of oil from the evaporator back to the compressor, and shaft seal means associated with the shaft of the impeller is provided with means creating a pumping action in the direction of the gear and bearing housing under conditions of a higher pressure in said gear and bearing housing than at the other end of the shaft seal means.

BRIEF DESCRIPTION OF THE DRAWINGS

FIG. 4 is a vertical sectional view corresponding to one taken along the line IV—IV of FIG. 2; and FIG. 5 is a fragmentary vertical sectional view illustrating the relationship of the impeller, impeller shaft, and the pumping shaft seal associated therewith.

DESCRIPTION OF THE PREFERRED EMBODIMENT

Figure 1:
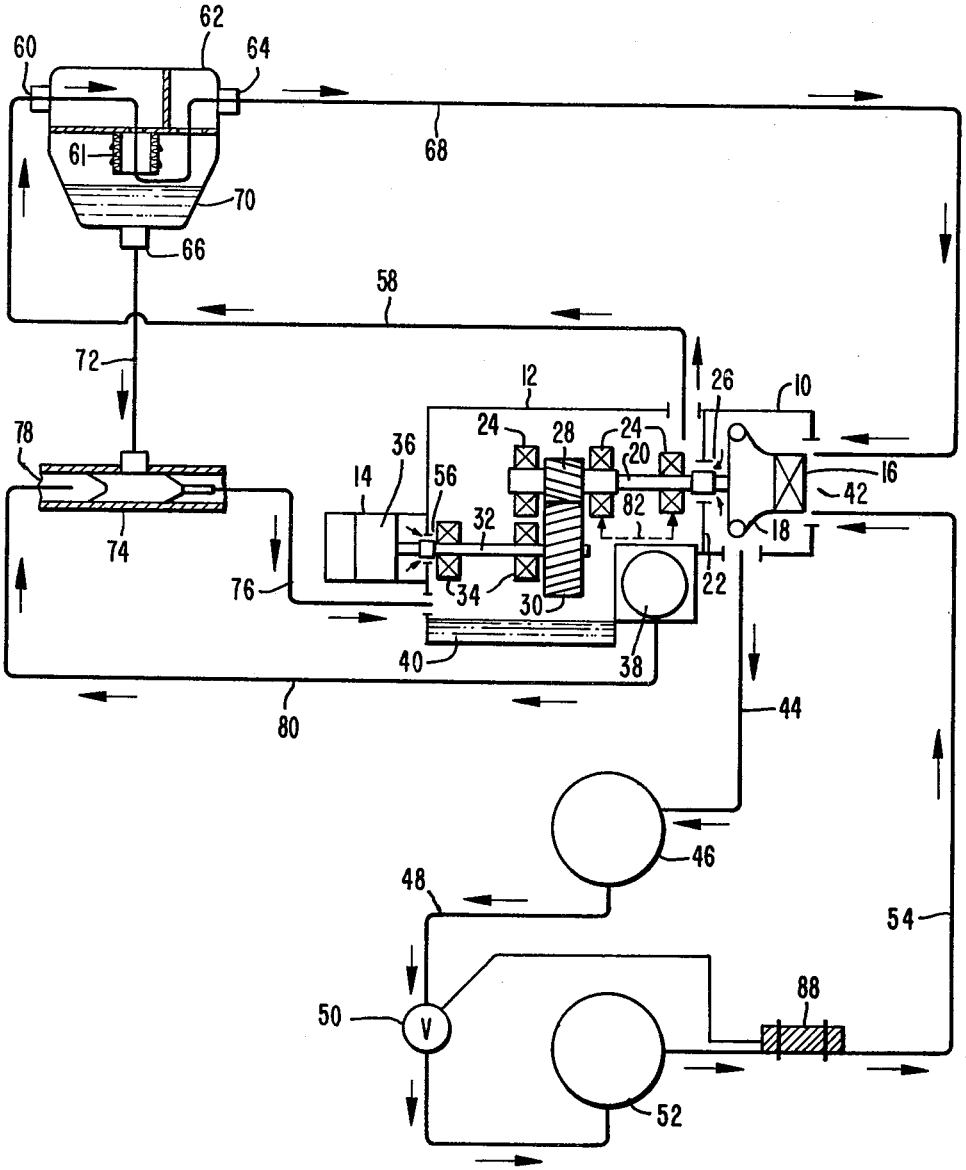
FIG. 1 is a diagrammatic view illustrating a system according to the invention including the refrigerant circuit and the oil circuit.

Referring to FIG. 1, the diagrammatically illustrated compressor of the type with which the invention is involved may be considered to comprise three main sections, the gas receiving and compressing section located in housing 10, the intermediate gear and bearing housing 12, and the opposite end motor housing 14. The housing 10 contains a high speed impeller 16 in a scroll 18, the impeller being driven by the high speed shaft 20 which extends through the wall 22 and is journaled in high speed bearings 24. A shaft seal arrangement is provided at the location 26 and will be explained in some detail later. A gear 28 on the high speed shaft 20 is driven by a much larger diameter gear 30 attached to low speed motor shaft 32 journaled in low speed bearings 34 and driven by the motor 36 in the motor housing 14. The interior of the gear and bearing housing also includes an electrically energized oil pump and centrifugal separator 38 and an oil sump portion 40.

For details of the general construction and arrangement of the compressor thus far described, reference should be had to the following U.S. Patents owned by the assignee of this application: U.S. Pat. No. 3,575,264 relating to certain parts of the lubrication system; U.S. Pat. No. 3,601,501 relating to the impeller mount; U.S. Pat. No. 3,619,086 and U.S. Pat. No. 3,635,579 relating to basic structural parts; and U.S. Pat. No. 3,635,580 relating to the inlet and capacity control structure.

The basic refrigerant circuit will now be explained. Refrigerant suction gas is drawn into the impeller 16 from the upstream or suction side 42 of the impeller, compressed, and discharged from the scroll 18 to pass through line 44 to the refrigerant condenser 46. There it is condensed and passes through line 48 to the expansion means 50. The low pressure refrigerant passes into the evaporator 52 and then passes through line 54 back to the suction space 42 at the impeller inlet.

The type of device to which this invention is particularly applicable is a packaged liquid chiller in which the compressor assembly, condenser and evaporator are arranged as a compact, unitary assembly which is important for installation in spaces having limited size access openings. The relevance of the invention to the compactness will be explained hereinafter.

The elements of the oil system will now be explained. As noted before, all centrifugal compressors of this type must vent from the gear and bearing housing 12 to the suction side of the refrigerant circuit, as at suction space 42, to prevent a pressure buildup in the gear and bearing housing 12 which can reach a value causing oil to be blown into the motor housing 14 through the seal 26. The venting system and oil return system diagrammatically shown in FIG. 1 includes the oil and refrigerant gas line 58 which carries refrigerant gas with entrained oil from the interior of the housing 12 to the inlet 60 of the coalescing filter housing 62. The housing contains a high efficiency coalescing filter medium 61 having its upstream side in communication with the inlet 60 and its downstream side in communication with a refrigerant gas outlet 64 and an oil outlet 66. The substantially oil free refrigerant gas passes through line 68 back to the suction space 42 while the oil in the bottom 70 of the filter housing passes through the outlet 66 through line 72 to oil pump means designated 74 which returns the oil through line 76 to the interior of the gear and bearing housing 12. In the preferred form, the oil pumping means 74 is a jet pump having a motive fluid inlet 78 into which high pressure oil is received from line 80 which receives oil from the oil pump 38 in the gear and bearing housing.

The primary purpose of the oil pump 38 is to provide the necessary amount of oil at an adequate pressure to properly lubricate the various bearings for the low and high speed shafts. As such, the dash lines 82 are exemplary of the various oil lines (not shown) which lead to all of the bearings in the gear and bearing housing. Oil from the pump is also used to supply pressure to the hydraulic piston arrangement used to position inlet guide vanes (neither of which is shown). In any event, the oil pump 38 has more than adequate capacity for these purposes and accordingly it provides a convenient source to bleed off sufficient high pressure oil through the line 80 to the jet pump 74 to provide a forced return of the oil from the filter back to the gear and bearing housing.

The return of the oil from the filter housing is not accomplished by gravity flow but is rather forced back by pump means since the pressure in the interior of the gear and bearing housing is higher than that at the suction space 42, and therefore the pressure condition of the oil on the downstream side of the filter medium 61 must also necessarily be lower than that of the interior of the gear and bearing housing. Of course if an oil filter and accumulator were located at a sufficiently high elevation relative to the gear and bearing housing that the head obtained by the difference in height exceeded the pressure difference between the interior of the gear and bearing housing and the suction space, then a gravity flow condition could be obtained. However, this would be inconsistent with the idea of a compact packaged chiller unit, and it could also create problems with the unit having a height in excess of the height of access openings to the space in which the unit is to be installed.

Another alternative to obtain oil return to the gear and bearing housing is to locate an oil filter and accumulator at a height which is not adequate to provide gravity return during operation of the compressor, but which does permit gravity return when the compressor is shut down. This arrangement corresponds to that used on certain chiller units of applicant's assignee but the arrangement is distinctly disadvantageous in that it requires periodic shutdowns.

Since the use of a high efficiency coalescing filter constitutes a large and key part of the system of the invention, some explanation of the differences in the separation mechanism of a coalescing filter as distinguished from the conventional filtering mechanism is considered apropos. In conventional filters the particles, whether liquid or solid, to be separated from the gas are intended to be restrained either on the upstream side of the filter medium or within the filter medium itself, while the gas is the only part intended to leave the downstream side of the filter medium. In conventional mechanical filters the collection of the particles at the filter medium is typically by a combination of a sieving action and probably to a greater degree by an impingement or impaction action upon the materials of the medium. In any event the collected particles are either upstream of or in the filter medium. In a high efficiency coalescing type filter, there is capture through both Brownian motion and inertial mechanisms with liquid particles in such a coalescing filter migrating along the fibers of the filter medium to crossover points where agglomeration of the smaller liquid particles takes place. Eventually the collected liquid appears on the downstream side of the medium as larger droplets and, as such, drain to the bottom of the filter housing.

It is noted that applicant makes no claim of having invented coalescing type filters, but does claim to have recognized the significant usefulness of a high efficiency coalescing filter in the centrifugal compressor environment as disclosed herein. Such coalescing type filters are commercially available from Balston, Inc. of Lexington, Massachusetts, in sizes and grades particularly useful with centrifugal refrigerant compressors used with various sizes of liquid chiller packages. In the previous practice, as explained in the noted U.S. Pat. No. 3,927,890, the relatively small oil mist particles, such as those which are 2 microns and smaller and which are not separated by the centrifugal separator part of the oil pump assembly 38, were vented along with the refrigerant gas to a filter and oil accumulator. That filter and oil accumulator was provided with a filter medium intended to prevent the passage of those particles greater than about 0.4 microns through the vent line back to the suction side of the refrigerant system. While the intent of this prior art arrangement was that the particles be sieved out by the filter medium, the accumulator had to have a relatively large cross-sectional area to function satisfactorily to separate the oil particles from the gas and store them. Thus it is my view that the action actually occurring in the prior art accumulator was not so much a filtering action as a settling action obtained by greatly reducing the velocity of the gas through the accumulator so that the relatively small oil particles would have an opportunity to settle rather than being filtered out. Thus the prior art oil filter and accumulator tank had to be quite large in cross-section and accordingly was costly in contrast with the relatively small and inexpensive filter housing 62.

Figure 2:
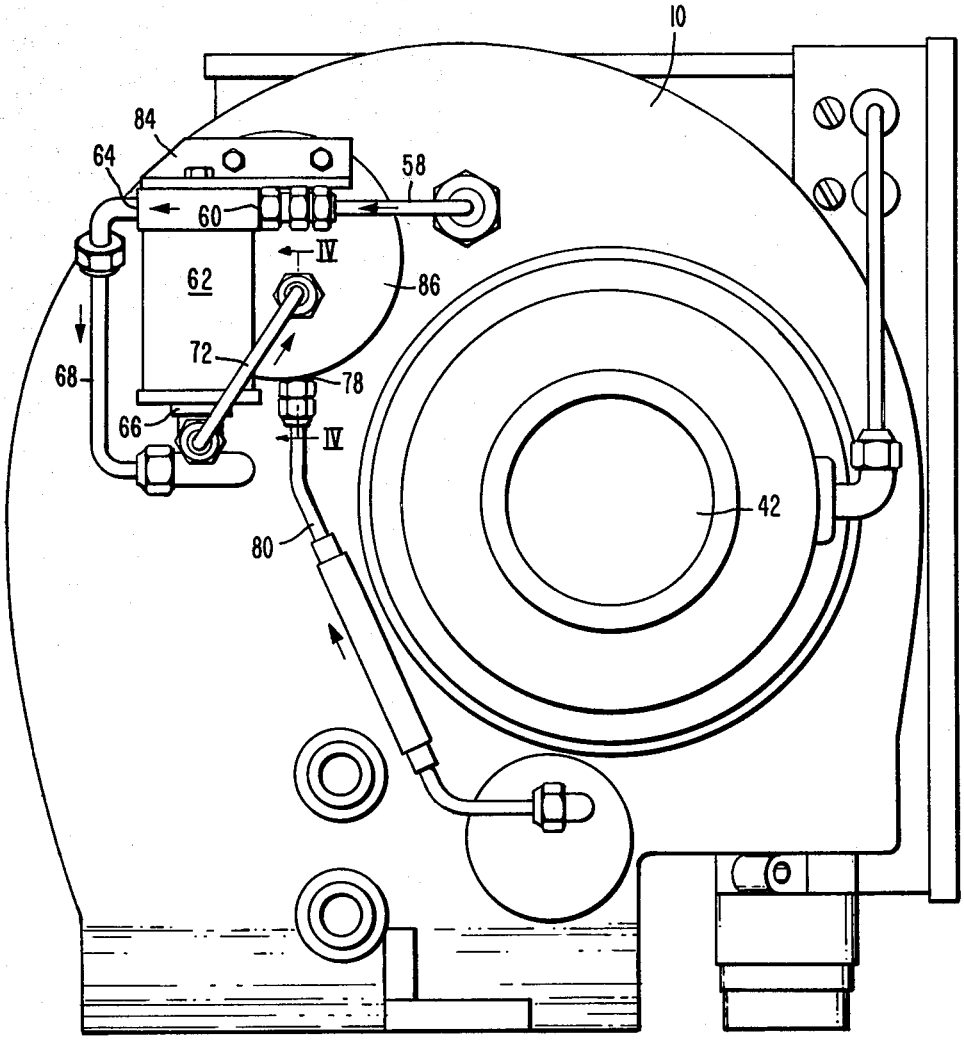
FIG. 2 is a fragmentary elevational view of the end of the compressor at which refrigerant is received and discharged for showing the arrangement of the oil and gas separator and connecting lines.
Figure 3:
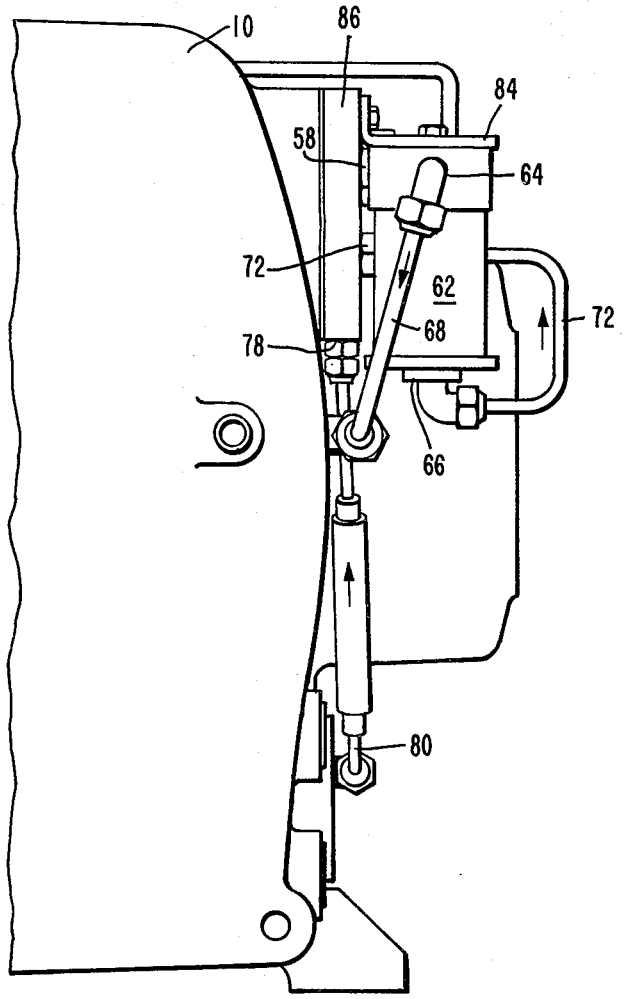
FIG. 3 is a fragmentary side view of the compressor end and parts shown in FIG. 2.

FIGS. 2 and 3 illustrate the mounting arrangement of the coalescing filter housing 62 and the interconnections between the filter housing and the other parts of the compressor system. It will be observed that the filter housing and connections are basically within the side and end profiles of the compressor so that compactness is maintained. The filter housing is supported from a bracket 84 secured to what is called a spin-down piston plate 86. The refrigerant gas and entrained oil from the interior of the gear and bearing housing pass through line 58 to the filter housing 62. Inside the filter housing, as illustrated in the FIG. 1 showing of the filter, the oil coalesces on the exterior of the filter medium 61 and drains to the bottom of the housing while the practically oil free refrigerant passes through line 68 back into the housing 10 to the suction side space 42 of the impeller. The drained oil passes through line 72 to the inlet of the venturi which is formed within the plate 86. Referring to FIG. 4, as well as FIGS. 1 and 2, oil from the interior oil pump 38 passes through line 80 to the motive fluid inlet 78 of the venturi or jet pump 74 illustrated in FIG. 4 and thereby induces the flow of the oil through line 72 and back to the interior of the gear and bearing housing 12.

Another element referred to hereinbefore which aids in promoting the return of oil to the gear and bearing housing is the use of a thermostatically controlled expansion valve 50 (FIG. 1) which is responsive to the suction gas superheat through the sensing element 88 in heat transfer relation to the suction line 54. Conventional practice with chiller packages of the type with which the invention is concerned is to use a high side float valve which is set for a certain amount of subcooling in the condenser 46. This is generally satisfactory when the machine is operating at full load, but when the machine is operating at part load, which typically is most of the time, there is an increase in the degree of superheat of the suction gas leaving the evaporator. The float valve does not respond to that change.

The thermostatic expansion valve is set to operate with relatively low superheat as in the order of 0°–6° F. (0°–3° C. approximately). This promotes the carryout of oil with the suction gas. This may be understood from the following. Refrigerant in a so-called superheated state leaving the evaporator is not at a thermodynamically stable state point, but is rather a mixture of gas which is superheated above the superheat set point and liquid refrigerant drops mixed therewith. If the mixture were allowed to stabilize, so that all of the liquid droplets changed to a gas, a true superheat temperature would occur. Now in accordance with my view of the matter, with the superheat being maintained at a relatively low value, this insures that there will be adequate liquid refrigerant droplets in the gas that the oil droplets (which have more affinity for refrigerant in liquid than gaseous form) will be carried out of the evaporator.

Turning now to another feature of the system invention, shaft seal means associated with the shaft 20 are provided for creating a pumping action in the direction of the gear and bearing housing 12 interior under conditions of a higher pressure in the gear and bearing housing than at the other end of the shaft seal means. In the embodiment shown in FIG. 5, the shaft 20 carries a rotor 90 attached for rotation therewith, with the radially outer face 92 of the rotor facing the radially inner face 94 of a seal stator 96. The outer face 92 of the rotor is provided with a machine thread which spirals in a direction to move in the direction of the gear and bearing housing when the impeller is rotating in its normal direction of rotation. The purpose of this is to obtain a dynamic pumping action of oil and refrigerant vapor into the gear and bearing housing under conditions when there is a higher pressure in the gear and bearing housing than at the other end of the seal immediately behind the radially inner portion of the impeller 16. Under normal operation the suction gas enters the impeller and is accelerated to a higher velocity gas which is diffused to convert the kinetic energy to pressure in the conventional way. The pressure behind the impeller next to the shaft seal is lower than the impeller outlet pressure due to the radially outward pumping action of the impeller rear shroud. At moderate discharge pressures, the pressure at the shaft seal will be above the impeller inlet pressure. Thus the leakage through the seal will be in the direction of the gear and bearing housing interior. However, when the discharge pressure is low, under such conditions as start-up or low condenser pressure, the pressure behind the impeller may not be above the impeller inlet pressure at 42 and accordingly the pressure in the interior of the gear and bearing housing. Under such conditions, the threaded shaft seal means provides a pumping action pumping a quantity of oil and refrigerant vapor into the gear and bearing housing interior. I have found that a thread of 24 turns per inch functions satisfactorily for my purposes.

A similar arrangement may be provided at the shaft seal 56 between the drive motor housing 14 and the gear and bearing housing 12.

I claim:

1. In combination with a high speed centrigugal refrigerant compressor including a motor housing, a separate gear and bearing housing containing an oil sump, and a separate compressor casing containing a high speed impeller driven by a shaft extending into said casing from said gear and bearing housing, a system for venting refrigerant gas from said gear and bearing housing to the suction space of said compressor and continuously returning oil entrained in said vented refrigerant gas to said gear and bearing housing, comprising:

a relatively small coalescing filter housing having an oil and gas inlet, a gas outlet, and an oil outlet;

a high efficiency coalescing filter medium in said housing with the upstream side of said medium being in communication with said inlet, and both said gas and oil outlets being in communication with the downstream side of said medium;

an oil and refrigerant gas line connecting the interior of said gear and bearing housing to said oil and gas inlet of said filter housing;

a refrigerant gas line connecting said gas outlet to said suction space to provide a source of suction for venting refrigerant and entrained oil from said gear and bearing housing; and first oil pump means having an inlet connected to receive oil from said coalescing filter housing oil outlet and having an outlet connected to the interior of said gear and bearing housing to continuously return to said gear and bearing housing oil extracted from said coalescing filter medium while said compressor is operating.

2. The combination of claim 1 wherein:

said first oil pump means comprises a jet pump having a motive fluid inlet, a pumped fluid inlet, and an outlet.

3. The combination of claim 2 wherein:

said gear and bearing housing includes second oil pump means for supplying oil to the bearings in said gear and bearing housing; and a pressurized oil line connecting said jet pump motive fluid inlet to said second oil pump means.

4. In a refrigeration system having a high speed centrifugal compressor including a motor housing, a separate gear and bearing housing, and a separate compressor casing containing a high speed impeller driven by a shaft extending into said casing from said gear and bearing housing and a condenser and an evaporator, a system for promoting the continuous return of oil lost into the refrigerant circuit from the gear and bearing housing back into the gear and bearing housing, comprising:

a venting system connecting the gear and bearing housing to the suction space side of the compressor casing to prevent a pressure buildup in said gear and bearing housing;

a high efficiency coalescing filter in said venting system separating oil from the refrigerant gas in which it was entrained;

pump means for continuously pumping said separated oil back to said gear and bearing housing;

expansion valve means responsive to suction line temperatures to control admission of refrigerant to said evaporator to normally maintain a relatively low superheat in the range of about 0°-6° F. (0°-3° C.) to promote the removal of oil from said evaporator back to the compressor; and shaft seal means associated with said shaft for creating a pumping action in the direction of said gear and bearing housing under conditions of a higher pressure in said gear and bearing housing than at the other end of said shaft seal means.

5. In a system according to claim 4 wherein:

said pump means includes a jet pump.

6. In a system according to claim 4 wherein said shaft seal means comprises a threaded surface on a seal rotor.

* * * * *